US008181489B2

(12) United States Patent
Selter

(10) Patent No.: US 8,181,489 B2
(45) Date of Patent: May 22, 2012

(54) KNITTING TOOL

(75) Inventor: Thomas Selter, Altena (DE)

(73) Assignee: Gustav Selter GmbH & Co. KG, Altena (DE)

( * ) Notice: Subject to any disclaimer, the term of this patent is extended or adjusted under 35 U.S.C. 154(b) by 0 days.

(21) Appl. No.: 12/999,155

(22) PCT Filed: Aug. 26, 2009

(86) PCT No.: PCT/EP2009/061000

§ 371 (c)(1),
(2), (4) Date: Feb. 15, 2011

(87) PCT Pub. No.: WO2010/102680

PCT Pub. Date: Sep. 16, 2010

(65) Prior Publication Data

US 2011/0197636 A1 Aug. 18, 2011

(30) Foreign Application Priority Data

Mar. 9, 2009 (DE) ..... 20 2009 003 346 U

(51) Int. Cl.
*D04B 35/02* (2006.01)

(52) U.S. Cl. ..... 66/117

(58) Field of Classification Search ..... 66/116, 66/117, 118
See application file for complete search history.

(56) References Cited

U.S. PATENT DOCUMENTS

| | | | | | |
|---|---|---|---|---|---|
| 1,596,822 | A | * | 8/1926 | Fuchs | 81/15.7 |
| 1,999,691 | A | * | 4/1935 | Ghaham | 66/117 |
| 2,093,631 | A | * | 9/1937 | Burnham | 66/117 |
| 2,102,600 | A | | 12/1937 | Miller | |
| 2,183,791 | A | | 12/1939 | Dunn | |
| 2,208,124 | A | * | 7/1940 | Dunn | 66/117 |
| 2,242,880 | A | * | 5/1941 | Dunn | 66/117 |
| 2,309,528 | A | * | 1/1943 | Otting | 66/117 |
| 2,462,473 | A | * | 2/1949 | Delaney | 66/117 |
| 2,551,414 | A | * | 5/1951 | Burnside | 604/193 |
| 2,633,720 | A | * | 4/1953 | Robbins | 66/117 |
| 3,280,595 | A | * | 10/1966 | Linstead | 66/117 |
| 4,007,610 | A | | 2/1977 | Linstead | |
| 4,341,094 | A | * | 7/1982 | Heide | 66/117 |
| 4,494,387 | A | * | 1/1985 | Phipps et al. | 66/117 |
| 4,680,947 | A | | 7/1987 | Phipps, Sr. | |
| 4,693,094 | A | * | 9/1987 | Kahn | 66/117 |
| 6,983,627 | B1 | * | 1/2006 | Eley-Holden-Sotnik | 66/117 |
| 7,954,342 | B2 | * | 6/2011 | Devagnanam | 66/117 |

FOREIGN PATENT DOCUMENTS

| | | |
|---|---|---|
| DE | 84 08 955.5 | 5/1984 |
| DE | 43 08 715 A1 | 9/1993 |
| GB | 2 265 159 A | 9/1993 |

* cited by examiner

*Primary Examiner* — Danny Worrell

(74) *Attorney, Agent, or Firm* — Abel Law Group, LLP

(57) ABSTRACT

The present invention relates to a knitting tool 1 in which a knitting point 2 is joined to a flexible cord 3 for holding the knitted product, wherein the knitting point 2 and the flexible cord 3 are joined to one another by means of a coupling device 4 and the coupling device 4 has at least two elements 5, 6 that can be releasably coupled to one another by means of a bayonet catch.

14 Claims, 9 Drawing Sheets

KNITTING TOOL

BACKGROUND OF THE INVENTION

1. Field of the Invention

The present invention relates to a knitting tool, in which a knitting point is joined to a flexible cord for holding the knitted product by means of a bayonet catch, which enables knitting points of different needle thickness to be combined in an instant with cords of different length and to be repeatedly reconfigured as desired.

2. Discussion of Background Information

Knitting needles consisting of two knitting points joined by a flexible central part are generally known by the term circular knitting needle. Circular knitted goods of larger diameter are worked by means of circular knitting needles. The total length of a circular knitting needle is dependent on the dimensions of the knitted product and usually ranges between approximately 40 cm and 120 cm. Besides their length, circular knitting needles are primarily characterised by the diameter of the knitting points. A quite specific diameter is necessary depending on the type of knitting material to be processed. Knitting points of 2 mm to 20 mm are usually used. Therefore, 10 to 20 different diameters result depending on graduation.

Since needles of all diameters should be available respectively with all central part lengths, a plurality of combination possibilities results. In practice, this means that new circular knitting needles must constantly be provided or held ready for different sizes of knitting product, different knitting material etc. to combine the necessary diameter of the needles with the necessary length of the central part.

Knitting tools with variable length are already known from the prior art.

The publication DE 38 16 483 discloses a circular knitting needle, in which the two knitting points are joined to the central part by a screw catch, which enables the needles and central part to be separated at any time.

The publication G 84 08 955.5 describes a circular knitting needle consisting of two short hand knitting rods that are joined to one another by a flexible wire-type part. The wire-type part is itself composed of two sections, which are respectively fixedly joined to the hand knitting rods, wherein one section of the wire-type part is inserted telescopically into the other section of the wire-type part configured in tubular form and can be locked in place by a clamp catch to be adjustable in length.

U.S. Pat. No. 4,680,947 discloses a knitting tool, in which the knitting needles are joined to the flexible wire by means of a thread.

A disadvantage of these knitting tools is that the catches can be partially or completely released during the knitting process by the unavoidable movement of the knitting tool and the resulting vibrations, and as a result of this either the stitches become caught on the partially released catches or the stitches fall off the knitting tool at the completely released catches.

Therefore, it is an object of the invention to provide a knitting tool, in which needles of different diameter and cords of different length can be combined flexibly and simply with a quick and simple connection mechanism, which at the same time assures a reliable and permanent connection.

This object is achieved according to the invention in that at least one knitting point and a flexible cord for holding the knitted product are joined to one another by means of a coupling device. The coupling device has at least two elements that can be coupled to one another. The elements that can be coupled comprise a socket element and a plug element. To achieve a simple assembly and disassembly of the knitting point and the flexible cord, the elements that can be coupled can be releasably joined to one another by means of a bayonet catch. The socket element is pushed over a plug element and firmly locked in place by means of a bayonet catch. The socket element is integrated into the end of the knitting point, whereas the plug element is fastened to an end of the flexible cord. A reverse arrangement (plug at the end of the knitting point and socket at the end of the flexible cord) is also conceivable. Such a mechanism prevents the connection between the knitting point and the flexible cord from loosening or releasing independently, so that the quality of the connection is increased. Moreover, a substantially stepless transition between the end of the knitting point and the flexible cord is assured as a result of this arrangement.

Bayonet catches are known in different embodiments from the prior art. In general, a bayonet catch refers to a device for connecting two parts, in particular rods, sleeves, pipes, in an easily releasable manner in the direction of their longitudinal axis. One (male) part has raised areas or pins at its end that are inserted into recesses, slots or grooves in the other (female) part and are moved as far as a stop by rotating in an annular slot or an annular groove. In another embodiment, the bayonet catch consists of a cylindrical shaft with radial projections or raised areas that cooperate with a tube connection piece with inwardly directed radial projections or raised areas. In this case, the projections or raised areas are spaced at least so far apart when viewed in circumferential direction that the radial projections of the mating part of the bayonet catch can engage into these spaces, so that in a specific position of rotation both parts are axially displaceable relative to one another. In the fully engaged position, the two elements are rotatable relative to one another, so that the projections of both elements come to lie one behind the other and prevent axial displacement of the elements relative to one another.

To prevent such connections from releasing independently, additional safeguards against loosening of the connection must be provided. For this purpose, the parts are configured so that they are firmly clamped by a spring or wedge action. Locking by means of a spring action is achieved by providing a spring in addition to the two parts that presses one of the parts into the other by means of spring force. As a result, the part to be locked in place is located in an exact immovable position after the connection process.

SUMMARY OF THE INVENTION

Such bayonet catches provide a reliable and permanent connection that can be released again merely be a press and turn movement exerted with force application.

Bayonet catches are present today, for example, on interchangeable lenses for photographic cameras, plug connections for cables, espresso machines, bulbs for vehicle headlights, fuel tank caps for motor vehicles, neck chain catches, hose couplings etc.

In the embodiment of the knitting tool according to the invention, different replaceable knitting points that can differ in thickness, for example, can be joined to a flexible cord. Moreover, the knitting tool according to the invention can also be varied with respect to the configuration of the flexible cord in that a plurality of flexible cords of different length, for example, can be joined to a specific knitting point.

A particular advantage is that the knitting tool according to the invention can be configured both in the form of a single knitting needle or can also be configured as a circular knitting needle with two knitting points and a flexible cord joining these to hold the stitches of the knitted product.

In an ergonomic configuration, the knitting tool according to the invention can be bent off in an area behind the conically extending end region of the knitting point. This is particularly important if the knitting tool is used for knitting cylindrical handwork with a relatively small diameter. Indicated here by way of example is a bend in the transition area between the knitting point and the flexible cord of a circular knitting needle, as a result of which the freedom of movement of the two knitting points of the circular knitting needle relative to one another is assisted.

BRIEF DESCRIPTION OF THE DRAWINGS

Other features and advantages of the present invention will now be explained in more detail with reference to the embodiments shown in the attached figures. These serve merely to explain the invention in an exemplary manner and are not restrictive to the scope of the invention.

DETAILED DESCRIPTION OF THE INVENTION

Figure 1:
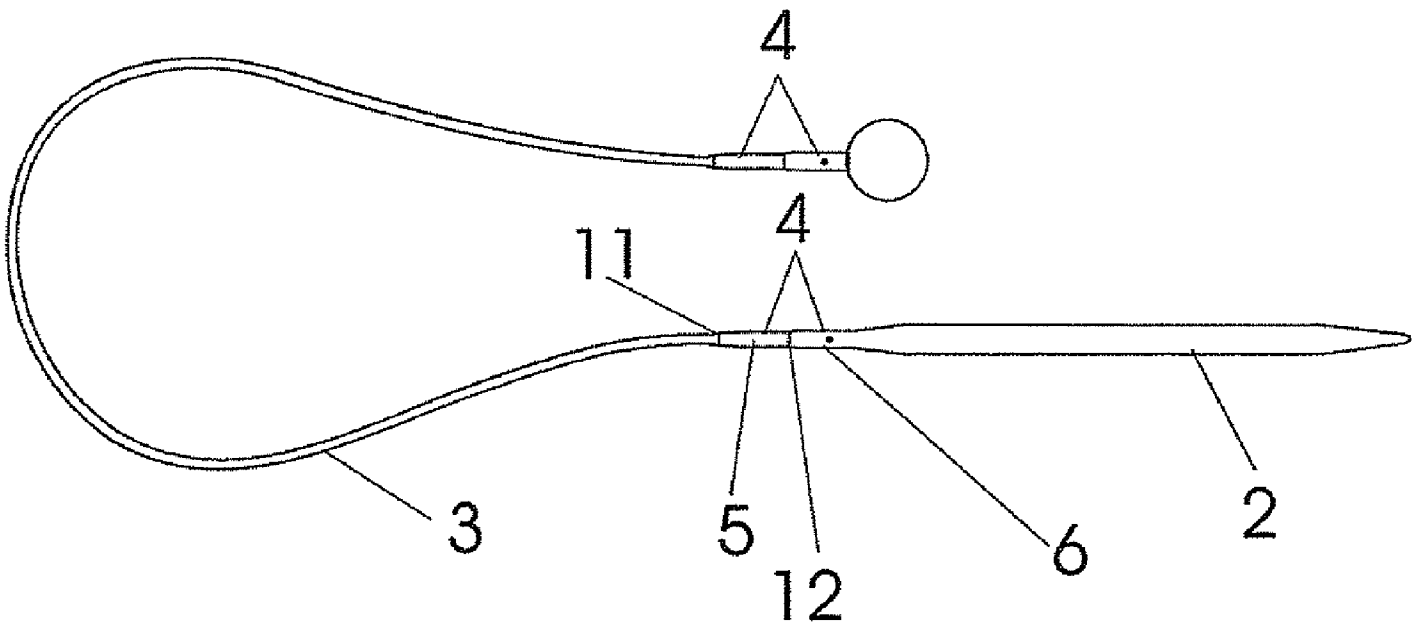
FIG. 1 is a side view of a knitting tool according to the invention.

FIG. 1 shows an exemplary embodiment of the knitting tool 1 according to the invention in the form of a single knitting needle with a conically tapering knitting point 2 in its end region and a flexible cord 3 for holding the stitches of the knitted product. The knitting point 2 is releasably joined to the flexible cord 3 by means of a coupling device 4. The coupling device 4 has at least two elements that can be coupled. The elements that can be coupled comprise a plug element 5 and also a socket element 6. The plug element 5 and the socket element 6 are firmly engaged with one another (locked in place) by means of a bayonet catch.

In a preferred embodiment, one plug element 5 of the flexible cord is provided with a coupling element 13, e.g. in the form of a ball or other suitable body, in which the diameter is larger than the diameter of the flexible cord. This coupling element 13 can be fastened to the flexible cord instead of a further knitting point and has the same connection mechanism as that which will be described in detail below for the knitting point 2. This prevents the stitches of the knitted product from falling off the flexible cord.

Figure 2:
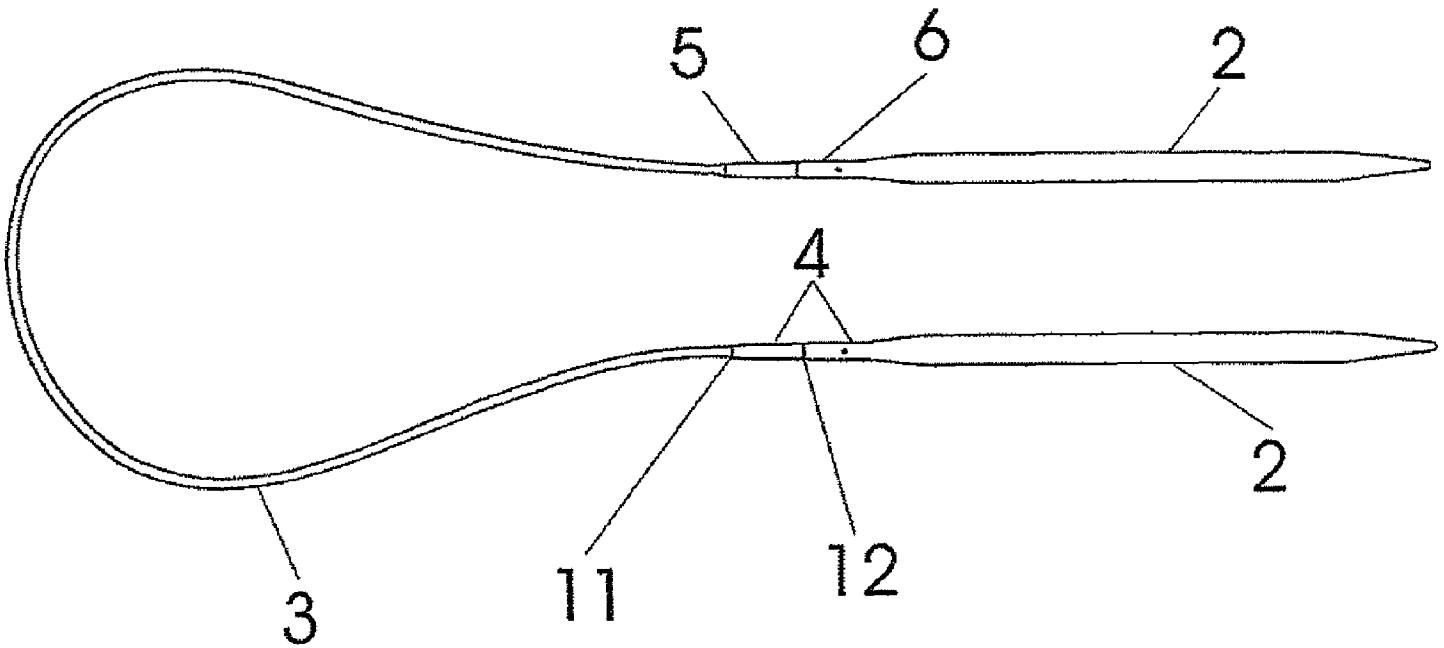
FIG. 2 is a side view of a further embodiment of the knitting tool according to the invention.

FIG. 2 shows a preferred exemplary embodiment of the knitting tool 1 according to the invention in the form of a circular knitting needle with two conically tapering knitting points 2 in its end regions and a flexible cord 3 for holding the stitches of the knitted product that connects two knitting points 2. The knitting points 2 are releasably joined to one another with the flexible cord 3 by means of a coupling device 4. The coupling device 4 has at least two elements that can be coupled. The elements that can be coupled comprise a plug element 5 and also a socket element 6, which are firmly engaged with one another (locked in place) by means of a bayonet catch.

Figure 3:
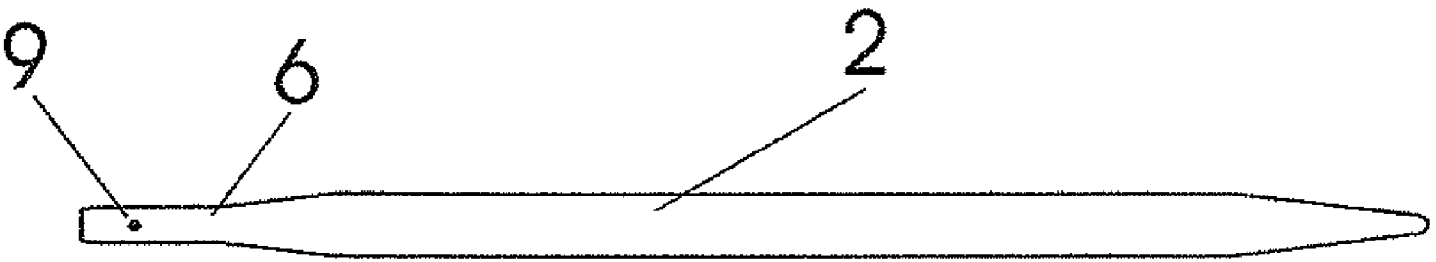
FIG. 3 is a side view of a knitting point with socket element.

As illustrated in FIG. 3, the knitting point 2 has a socket element 6 integrated into its end 12. In this case, the socket element can either be inserted as independent element into a hole in the knitting point 2 appropriate for it, or alternatively the end of the knitting point 2 can itself be configured as socket element. In a preferred embodiment, the end of the knitting point 2 is conically tapered. This has the advantage that the stitches of the knitted product can slide more easily over the elements that can be coupled onto the flexible cord and not become caught at the connection points between the knitting point 2 and the flexible cord 3. In an even more preferred embodiment, the socket element 6 is an extension of the conically extending end of the knitting point 2. This latter embodiment has the advantage that an even more uniform transition area is obtained between the outside diameter of the knitting point 2 and the outside diameter of the flexible cord 2.

Figure 4:
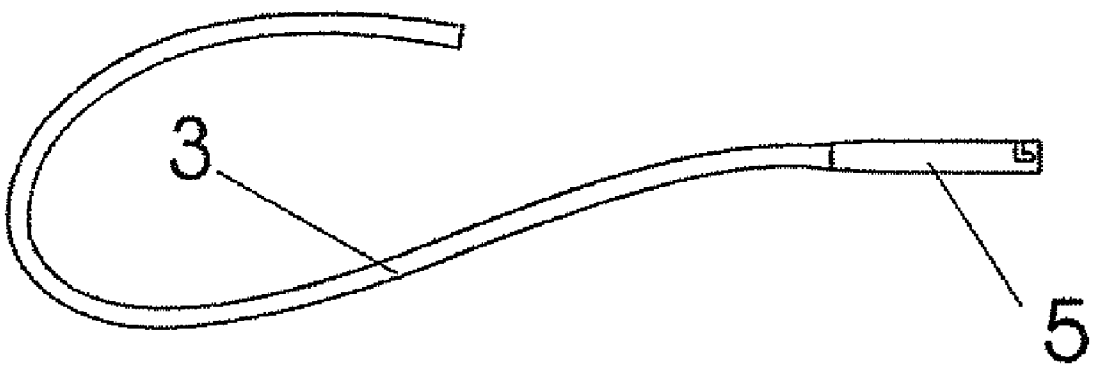
FIG. 4 is a side view of the flexible cord with plug element.

FIG. 4 shows the flexible cord 3 of the knitting tool 1 that has a plug element at each of its two ends 11,11. The flexible cord usually consists of plastic threads, for example, preferably polyamide thread, plastic tubing, wire cord or a plaited wire cord of high flexibility etc., as is known to a skilled person in this field. The diameter of the flexible cord is matched to the diameter of the rear opening of the plug element 5. The flexible cord 3 is permanently fastened to the plug element 5 using usual methods, e.g. by means of a suitable adhesive. For this, the flexible cord is inserted into the rear opening of the plug element 5 and glued. Alternatively, the rear opening, into which the flexible cord is inserted, can be clamped to the flexible cord by mechanical processing. In a further embodiment, the flexible cord is welded or riveted to the opening of the plug element 5.

Figure 5:
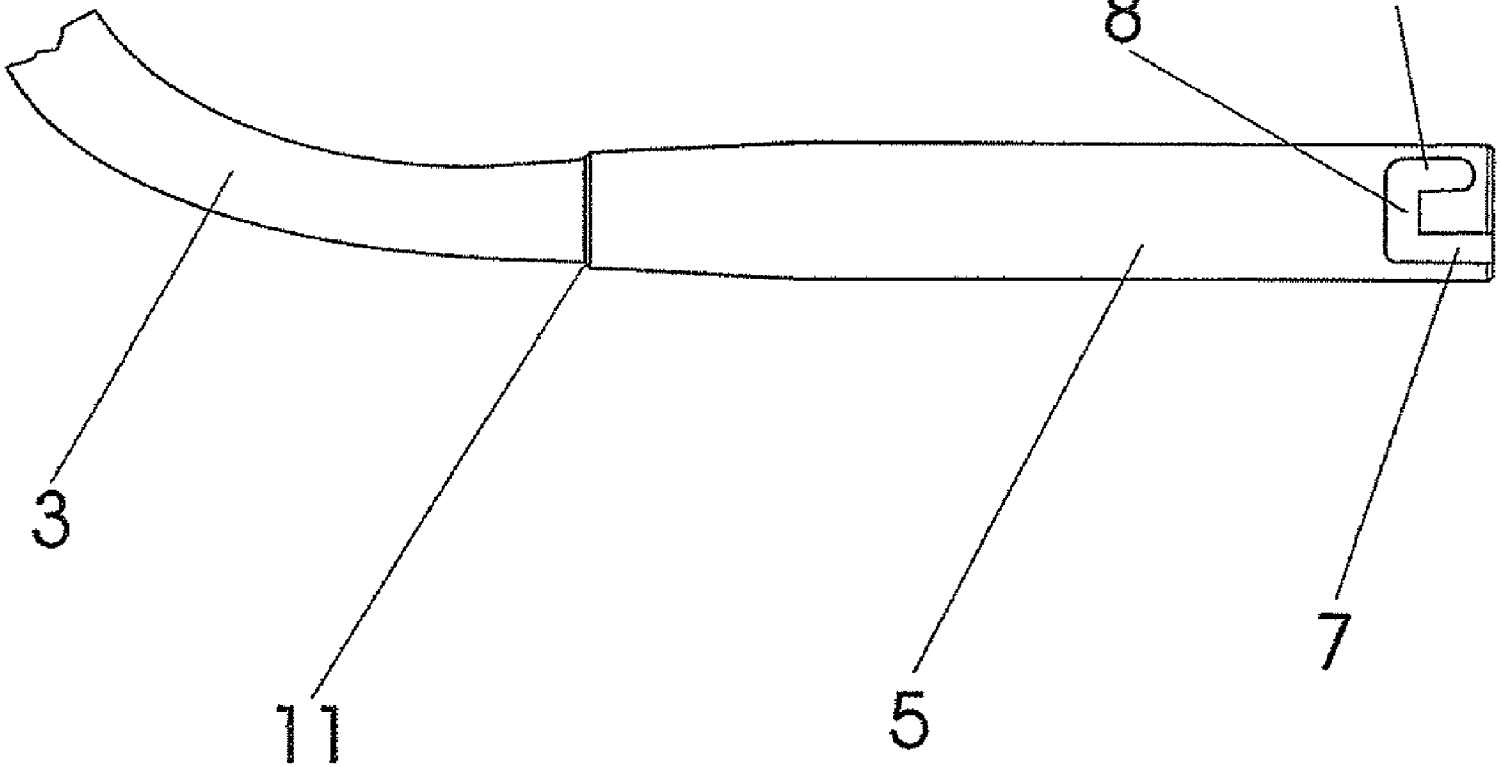
FIG. 5 is a side view of a plug element.

FIG. 5 is a side view of the plug element 5. In the embodiment of the invention shown by way of example, the plug element 5 is configured such that it has at least one, preferably two or more, recess(es) in the form of a slot or a groove 7 acting as holding elements in the longitudinal direction of the plug element 5. A transverse slot or a transverse groove 8 adjoins the end of the slot or the groove 7 substantially at right angles.

In a preferred embodiment, the recess has a substantially L-shaped form, wherein the longer leg of the recess is arranged in the direction of insertion of the plug element 5 and the shorter leg runs substantially at right angles to the longer leg.

The transverse slot or the transverse groove 8 advantageously merges into a slot or groove extension 14 at its end and the region that locks the at least one radial raised area 9 of the socket element in place. This locking region again runs substantially parallel to the direction of insertion of the plug element 5.

According to a preferred further development, the plug element 5 preferably has at least two recesses, which are configured as symmetrically arranged guide grooves, for example. A stable guidance is assured as a result of this.

Figure 6:
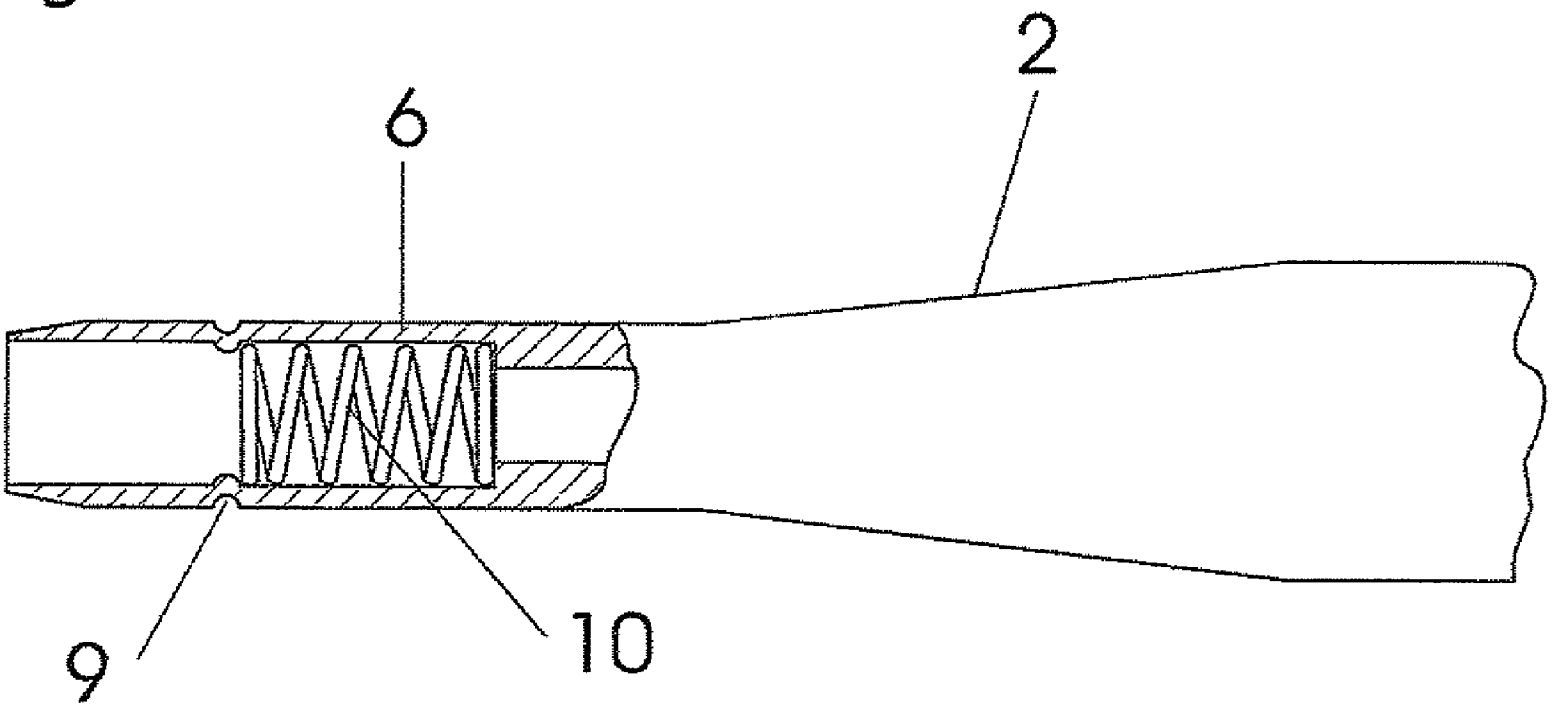
FIG. 6 is a sectional view of a socket element.

FIG. 6 is a sectional view of the socket element 6. In the embodiment of the invention shown by way of example, the socket element 6 is configured such that it has at least one, preferably two or more radial raised area(s) 9 on its inside. This radial raised area 9 can be configured as a projection, pin or other raised area, so long as it is suitable to interact or correspond with the recess of the plug element, which is configured as a slot or the groove 7.

In a preferred embodiment, a spring mechanism 10 is arranged on the base of the cylindrical cavity of the socket element 6, i.e. on the side remote from the plug element 5, to lock the plug element 5 in place on the socket element. The spring mechanism can be configured as a spring, for example. The spring has a diameter that is matched to the inside diameter of the socket element 6, i.e. which is at most equal in size to the inside diameter of the socket element 6. The radial raised area is secured in the slot or groove extension 14 by spring action by means of this spring mechanism. As a result, the plug element 5 to be secured is located in an exact immovable position after the closing process.

In a further embodiment, which is not illustrated by a figure, the plug element 5 can be configured so that it has at least one, preferably two or more radial raised area(s) 9 on its outer surface. This radial raised area 9 can be configured as a projection, pin or other raised area, so long as it is suitable to interact or correspond with the slot or the groove of the socket element 6. In this embodiment, the socket element 6 is configured such that it has at least one, preferably two or more, recess(es) in the form of a slot or a groove 7 on its inside acting as holding elements in the longitudinal direction of the socket element 6. A transverse slot or a transverse groove 8 adjoins the end of the slot or the groove 7 substantially at right angles.

In a preferred embodiment, the recess has a substantially L-shaped form, wherein the longer leg of the recess is arranged in the direction of insertion of the plug element 5 and the shorter leg runs substantially at right angles to the longer leg and at its end merges into a region locking the radial raised area 9 of the socket element in place. This locking region preferably again runs substantially parallel to the direction of insertion of the plug element 5.

The dimensions of the individual components should be selected and adapted to one another in such a way that the bayonet principle is assured.

Figure 7:
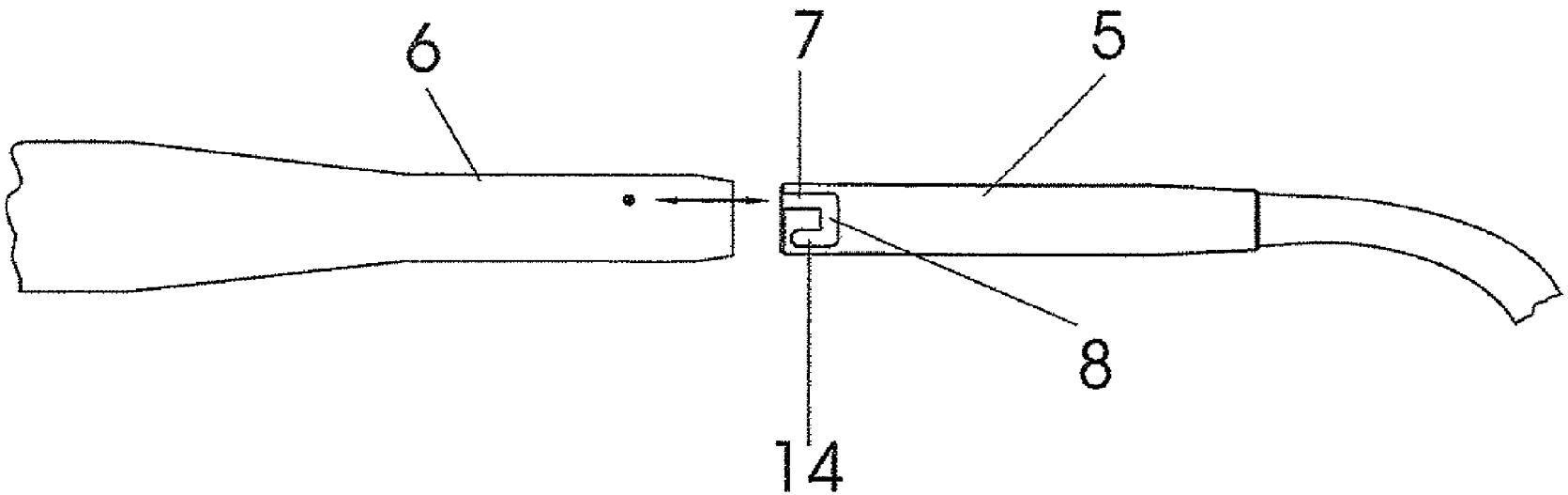
FIG. 7 is a side view of a plug element and a socket element in assembly position.

To achieve a simple assembly of the knitting point 2 on the flexible cord 3, as illustrated in FIG. 7, the socket element 6 is pushed or attached over the plug element 5, i.e. in such a manner that the at least one radial raised area 9 is firstly inserted into the at least one slot or the at least one groove 7 of the plug element 5. In this case, the radial raised area 9 advantageously engages with a precise fit into the slot or the groove 7, so that the plug element 5 can be pushed along the longitudinal axis of the socket element 6 by means of this guide, i.e. against the clamping force of the spring mechanism 10. As soon as the socket element 6 abuts against the lower ends of the slot or the groove 7, it is rotated in a direction perpendicular to the direction of insertion, i.e. in a rotation to the right, for example, into the transverse slot or the transverse groove 8. After abutting against the respective boundary edge of the transverse slot or the transverse groove 8 once again, the socket element 6 is pressed into the associated slot or groove extension 14 at its radial raised area 9 by means of the spring forces of the spring 10. Thus, as a result of the spring action the radial raised area 9 of the socket element 6 locks into the corresponding slot or groove extension 14 to be locked securely against rotation.

The above-described process is conducted in reverse for release of the connection, i.e. the socket element 6 is firstly pressed against the plug element 5 to disengage the radial raised area 9 from the slot or groove extension 14 and then rotated into the transverse slot or the transverse groove 7 with a rotation to the left and then pulled from the plug element 5 along the slot or groove 7.

Figure 8:
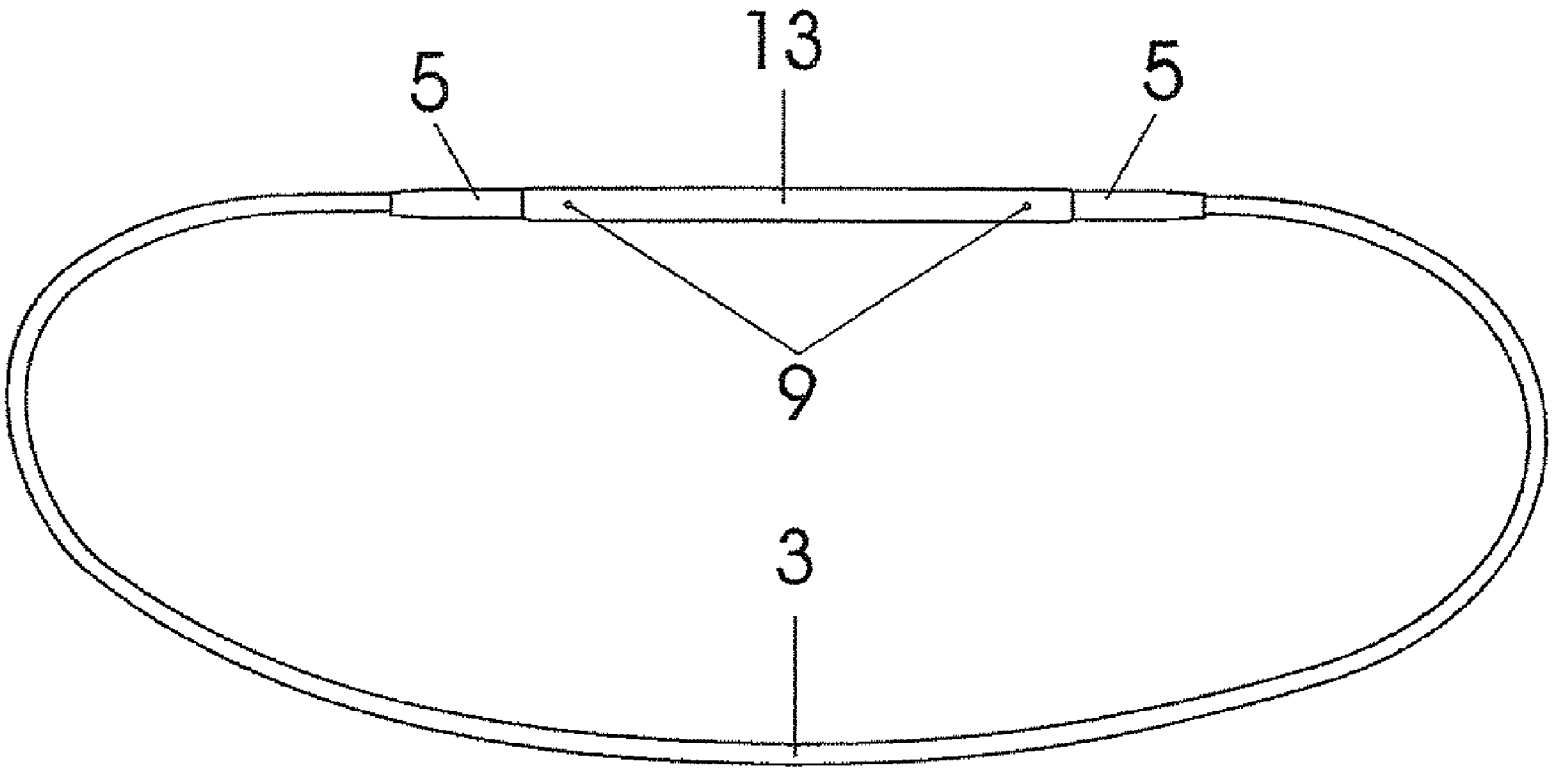
FIG. 8 is a side view of the flexible cord in combination with a coupling element.

FIG. 8 illustrates the flexible cord in combination with a coupling element 13. In this preferred embodiment the knitted product can be "left" on the flexible cord. In this case, the two ends of the flexible cord, which each have a plug element 5, are connected by means of the coupling element 13. The coupling element 13 can have any desired shape. In a preferred embodiment, the coupling element has the shape of a cylinder.

Figure 9:
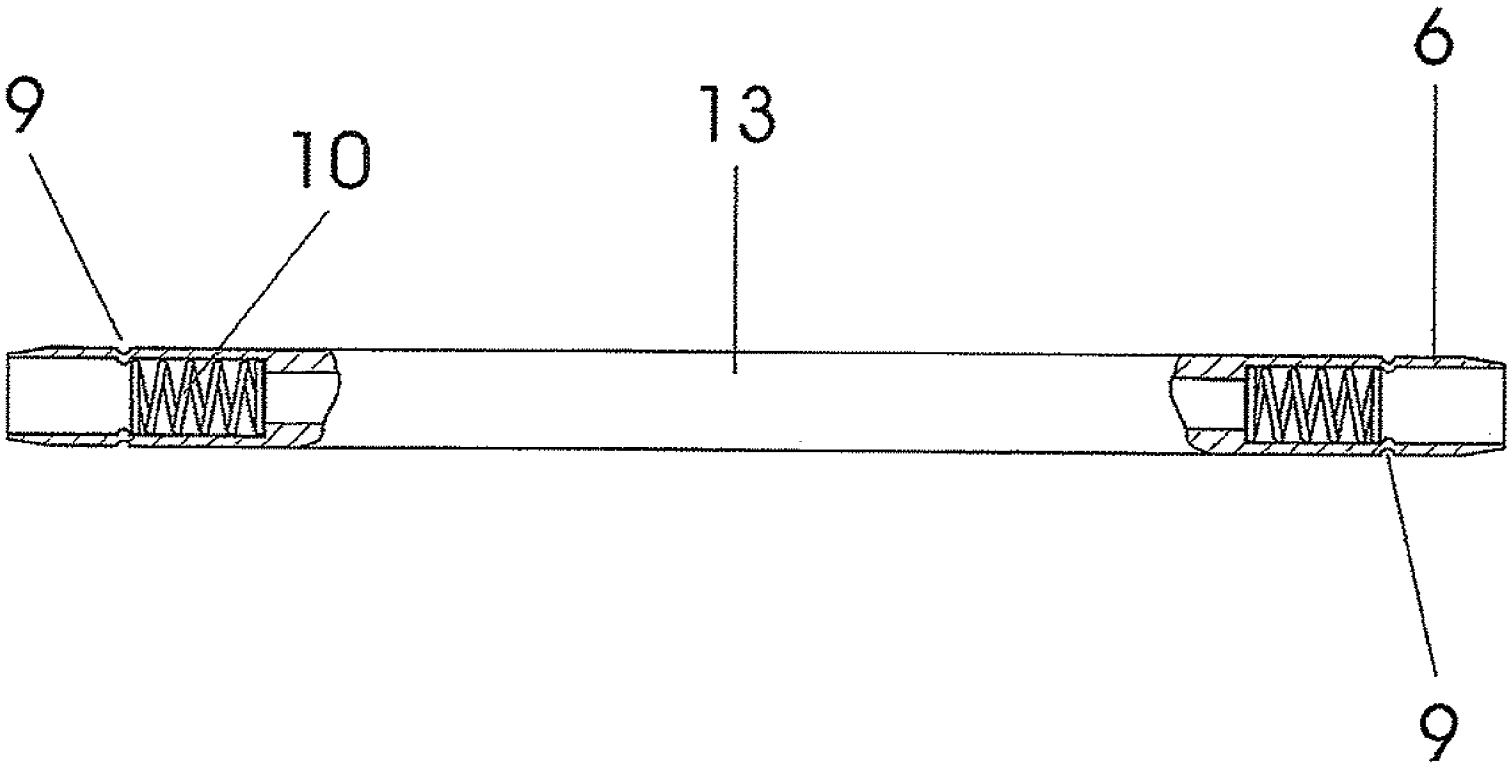
FIG. 9 is a side view of a coupling element.

As illustrated in detail in FIG. 9, the coupling element 13 has a socket element 6 at each of its two ends that is configured in the same manner as the socket element 6 of the knitting point 2. Assembly or disassembly of the coupling element 13 on the flexible cord occurs in the same manner as that described in detail above for the assembly or disassembly of the knitting point 2 on the flexible cord 3.

According to a further preferred embodiment, two or more flexible cords 3 can be coupled to one another by means of the coupling element 13 to thus extend the length of the flexible cord, which broadens the range of possible variations of the knitting set. The assembly or disassembly of the coupling element 13 on the flexible cord likewise occurs in the same manner as that described in detail above for the assembly or disassembly of the knitting point 2 on the flexible cord 3.

List of Reference Numerals

1 knitting tool
2 knitting point
3 flexible cord
4 coupling device
5 plug element
6 socket element
7 slot/groove
8 transverse slot/transverse groove
9 radial raised area
10 spring mechanism
11 end of the flexible cord
12 end of the knitting point
13 coupling element
14 slot or groove extension

What is claimed is:

1. A knitting tool, wherein the knitting tool comprises at least one knitting point and a flexible cord for holding a knitted product, the knitting point and the flexible cord being joined to each other by a coupling device that comprises at least two elements which can releasably be coupled to one another by a bayonet catch, the at least two elements comprising a plug element and a socket element, the plug element comprising a slot or a groove in its longitudinal direction, a transverse slot or a transverse groove adjoining an end of the slot or the groove at right angles.

2. The knitting tool of claim 1, wherein the transverse slot or transverse groove comprises a slot or groove extension.

3. The knitting tool of claim 1, wherein the socket element comprises at least one raised area on its inside.

4. The knitting tool of claim 1, wherein the socket element comprises a spring mechanism.

5. The knitting tool of claim 3, wherein the at least one raised area of the socket element is configured to be capable of engaging the longitudinal slot or groove and the transverse slot or transverse groove of the plug element.

6. The knitting tool of claim 1, wherein the socket element and the plug element are configured to be capable of being connected by an insert and turn movement.

7. The knitting tool of claim 1, wherein the flexible cord comprises a plug element at each of its ends.

8. The knitting tool of claim 1, wherein the knitting point comprises a socket element at its end.

9. The knitting tool of claim 8, wherein the socket element is integrated into an end of the knitting point.

10. The knitting tool of claim 8, wherein the socket element is an extension of a conically extending end of the knitting point.

11. The knitting tool of claim 1, wherein the knitting tool is configured as a single knitting needle.

12. The knitting tool of claim 1, wherein the knitting tool is configured as a circular knitting needle and comprises two knitting points and a flexible cord.

13. The knitting tool of claim 1, wherein two plug elements of two flexible cords are connected to each other by a coupling element that comprises a socket element at each of its ends, the socket element comprising at least one raised area on its inside.

14. A knitting tool, wherein the knitting tool comprises at least one flexible cord that comprises a plug element at each of its ends, the plug elements being connected to each other by a coupling element that comprises a socket element at each of its ends, the socket element comprising at least one raised area on its inside, the at least one raised area on the inside of the socket element being capable of interacting or corresponding with a recess of a plug element, which recess is configured as a slot or a groove.

* * * * *